US012577896B2

(12) United States Patent
Odendall

(10) Patent No.: US 12,577,896 B2
(45) Date of Patent: Mar. 17, 2026

(54) METHOD FOR OPERATING A DRIVE DEVICE AND CORRESPONDING DRIVE DEVICE

(71) Applicant: AUDI AG, Ingolstadt (DE)

(72) Inventor: Bodo Odendall, Lenting (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 18/697,577

(22) PCT Filed: Sep. 28, 2022

(86) PCT No.: PCT/EP2022/077025
§ 371 (c)(1),
(2) Date: Apr. 1, 2024

(87) PCT Pub. No.: WO2023/052453
PCT Pub. Date: Apr. 6, 2023

(65) Prior Publication Data

US 2024/0410304 A1 Dec. 12, 2024

(30) Foreign Application Priority Data

Sep. 30, 2021 (DE) ..... 102021125380.2

(51) Int. Cl.
*F01N 3/20* (2006.01)
*F01N 9/00* (2006.01)

(52) U.S. Cl.
CPC ..... *F01N 3/20* (2013.01); *F01N 9/00* (2013.01); *F01N 2560/025* (2013.01); *F01N 2900/1624* (2013.01)

(58) Field of Classification Search
CPC ..... F01N 3/20; F01N 9/00; F01N 2560/025; F01N 2900/1624
See application file for complete search history.

(56) References Cited

U.S. PATENT DOCUMENTS 9,441,562 B2 * 9/2016 Odendall ..... F02D 35/0092
2009/0223499 A1 * 9/2009 Rosel ..... F01N 11/002 60/276

(Continued)

FOREIGN PATENT DOCUMENTS

DE 102005044729 A1 3/2007
DE 102004060125 B4 11/2007

(Continued)

OTHER PUBLICATIONS

International Preliminary Report on Patentability issued on Apr. 2, 2024, in corresponding International Application No. PCT/EP2022/077025, 7 pages.

(Continued)

*Primary Examiner* — Brandon D Lee
(74) *Attorney, Agent, or Firm* — Maier & Maier, PLLC

(57) ABSTRACT

A method for operating a drive device which has a drive unit that generates exhaust gas and an exhaust gas aftertreatment device for aftertreatment of the exhaust gas. A composition of a fuel-air mixture used for operating the drive unit is determined at least temporarily by a lambda control based on a first measured value of a first lambda sensor arranged upstream of the exhaust gas aftertreatment device and based on a second measured value of a second lambda sensor arranged downstream of the exhaust gas aftertreatment device.

19 Claims, 1 Drawing Sheet

(56) References Cited

U.S. PATENT DOCUMENTS

| | | | | |
|---|---|---|---|---|
| 2016/0061084 | A1* | 3/2016 | Okazaki | F02D 41/1454 60/287 |
| 2022/0112831 | A1* | 4/2022 | Fey | F01N 9/005 |
| 2023/0175450 | A1* | 6/2023 | Suzuki | F01N 3/101 60/285 |
| 2023/0323804 | A1* | 10/2023 | Matsushita | F02D 41/1456 60/276 |

FOREIGN PATENT DOCUMENTS

| | | | |
|---|---|---|---|
| DE | 102012019907 | A1 | 4/2014 |
| DE | 102016222418 | A1 | 5/2018 |
| DE | 102018203399 | A1 | 9/2018 |
| DE | 102018219978 | B3 | 11/2019 |
| DE | 102018251720 | A1 | 7/2020 |

OTHER PUBLICATIONS

International Search Report and Written Opinion issued on Jan. 23, 2023, in corresponding International Application No. PCT/EP2022/077025, 12 pages.

* cited by examiner

METHOD FOR OPERATING A DRIVE DEVICE AND CORRESPONDING DRIVE DEVICE

FIELD

The invention relates to a method for operating a drive device which has a drive unit that generates exhaust gas and an exhaust gas aftertreatment device for aftertreatment of the exhaust gas, wherein a composition of a fuel-air mixture used for operating the drive unit is determined at least temporarily by means of a lambda control based on a first measured value of a first lambda sensor arranged upstream of the exhaust gas aftertreatment direction and based on a second measured value of a second lambda sensor arranged downstream of the exhaust gas aftertreatment direction. The invention further concerns a drive device.

BACKGROUND

DE 10 2018 203 399 A1, for example, is known from the prior art. This document describes a method for analyzing the oxygen storage capacity of a catalyst arranged in an exhaust system of an internal combustion engine. The method includes decoupling the internal combustion engine from a drive train, driving the internal combustion engine by means of an electric motor, supplying a lean fuel-air mixture to the catalyst until the catalyst is completely charged with oxygen, supplying a rich fuel-air-mixture to the catalyst, determining time courses of combustion air conditions upstream and downstream of the catalyst and determining the amount of oxygen that can be stored in the catalyst from the determined time profiles of the combustion air conditions.

Furthermore, publication DE 10 2005 044 729 A1 discloses a method for lambda control in an internal combustion engine with at least one catalyst arranged in an exhaust system of the internal combustion engine, wherein the exhaust system has a front lambda control circuit and a rear lambda control circuit with at least one rear oxygen sensor arranged downstream of the catalyst, wherein an output signal from the rear oxygen sensor is processed by the rear lambda control circuit, a difference value relative to a rear target lambda value is formed and a control variable acting on the target lambda value of the front lambda control circuit is output. It is provided that after a change of sign of the difference value for a time interval since the change of sign, a balanced amount of oxygen is determined from the amount of oxygen entered into and discharged from the catalyst and the control variable of the rear lambda control circuit is additionally selected depending on the balance amount of oxygen.

SUMMARY

It is the object of the invention to propose a method for operating a drive device, which has advantages over known methods, which in particular allows adjusting an oxygen filling level of an oxygen storage of the exhaust gas aftertreatment device to a target filling level and/or determining an oxygen storage capacity of the oxygen storage with high accuracy.

This is achieved according to the invention with a method for operating a drive device. In this case, it is provided that in order to adjust an oxygen filling level of an oxygen storage of the exhaust gas aftertreatment device to a target filling level after an occurrence of a value of the second measured value which corresponds to a boundary value of a filling level range that contains the target filling level, the composition is set in such a way that the oxygen level changes by a pilot oxygen amount in the direction of the target level, then the composition is determined during a control period using the lambda control until the second measured value is at least within an unavoidable tolerance equal to a target value corresponding to the target level and finally the pilot oxygen amount is corrected by an oxygen balance value determined during the control period.

The method serves to operate the drive device, which is provided and designed, for example, to drive a motor vehicle and to this extent to provide a drive torque aimed at driving the motor vehicle. The drive device has the drive unit to provide the drive torque. The drive unit is supplied with fuel and oxygen or oxygen containing air during its operation or during the operation of the drive device, which react with one another in the drive unit. This produces exhaust gas which is discharged from the drive unit, in particular towards an external environment of the drive device.

Since the exhaust gas contains pollutants, after being discharged from the drive unit, it is first fed to the exhaust gas aftertreatment device, in particular before being released into the outside environment. The exhaust gas aftertreatment device preferably has at least one of the following devices: three-way catalyst, oxidation catalyst, NOx storage catalyst and SCR catalyst. Of course, the exhaust gas aftertreatment device can have exactly one or more of the devices mentioned or can be present as one or more of the devices mentioned.

With respect to a main flow direction of the exhaust gas, the first lambda sensor is located upstream of the exhaust gas aftertreatment device and the second lambda sensor is located downstream of the exhaust gas aftertreatment device. The first lambda sensor is used to measure the residual oxygen content of the exhaust gas upstream of the exhaust gas aftertreatment device, which is present in the exhaust gas, while the residual oxygen content present in the exhaust gas downstream of the exhaust gas aftertreatment direction is measured using the second lambda sensor. The first lambda sensor provides the first measured value and the second lambda sensor provides the second measured value.

The lambda control is carried out based on the two measured values, namely based on both the first measured value and the second measured value, which sets the composition of the fuel-air mixture that is supplied to the drive unit. In the narrower sense, the lambda control is carried out based on the first measured value, while a trim control is carried out based on the second measured value, which influences the lambda control and at least partially compensates for a possible error in the first lambda sensor. This provides a very high level of accuracy in the lambda control.

Preferably, a broadband lambda sensor is used as the first lambda sensor and a jump lambda sensor is used as the second lambda sensor. The broadband lambda sensor makes it possible to detect the residual oxygen content or the corresponding lambda value over a wider measuring range with respect to the jump lambda sensor. The jump lambda sensor, on the other hand, has a narrower measuring range than the broadband lambda sensor; in particular, it is used to detect a lambda value of one. However, the measurement accuracy of the jump lambda sensor is higher than that of the broadband lambda sensor. Deviations and errors of the first lambda sensor are at least partially compensated for using the trim control or using the second measured value from the second lambda sensor.

The exhaust gas aftertreatment device has an oxygen storage device, which in turn has a material which can absorb and temporarily store and subsequently release the oxygen contained in the exhaust gas. In particular, if there is an excess of oxygen in the exhaust gas, oxygen from the exhaust gas is introduced into the oxygen storage, whereas if there is a lack of oxygen in the exhaust gas, oxygen is extracted from the oxygen storage and discharged into the exhaust gas. This ensures proper functioning of the exhaust gas aftertreatment device and, above all, effective conversion of pollutants contained in the exhaust gas into less dangerous products.

The efficiency of the exhaust gas aftertreatment device, i.e. the extent to which the pollutants can be converted into less dangerous products, depends in particular on the operating conditions of the exhaust gas aftertreatment device and the oxygen filling level of the oxygen storage. The operating conditions are to be understood in particular as meaning an operating temperature of the exhaust gas aftertreatment device. For example, the efficiency of the exhaust gas aftertreatment device is at its optimum at an operating temperature of the exhaust gas aftertreatment device and decreases towards lower temperatures.

To achieve optimal efficiency of the exhaust gas aftertreatment device, the oxygen level of the oxygen storage should also be between 30% and 50% (these values are included). In any case, the oxygen storage must not be completely emptied and not completely filled with oxygen. In order to set the oxygen level to a target filling level, which is in particular at least 30% and at most 50%, it is necessary to know the oxygen storage capacity of the oxygen storage or at least to determine the amount of oxygen that must be introduced therein, starting from a completely empty oxygen storage, or must be discharged from it starting from a completely filled oxygen storage in order to adjust the oxygen level to the target level.

For example, it can be provided here that the drive unit is initially to be operated in order to achieve a lean exhaust gas until the second measured value of the second lambda sensor indicates an excess of oxygen. The drive device is then operated to generate rich exhaust gas until the second measured value indicates a lack of oxygen. From switching from operating the drive unit for generating the lean exhaust gas to determining the lack of oxygen using the second lambda sensor, the oxygen balance value is determined, which describes the amount of oxygen discharged from the oxygen storage during the specified period. The oxygen balance value results, for example, from the composition of the fuel-air mixture and its throughput in the drive unit or from the first measured value and the second measured value as well as an exhaust gas throughput through the exhaust gas aftertreatment device. The oxygen storage capacity of the oxygen storage is then determined from the oxygen balance value.

The reverse procedure can of course also be implemented, in which the drive unit is initially operated to generate rich exhaust gas until the second measured value indicates a lack of oxygen. The drive unit is then used to operate lean exhaust gases, again until the second measured value indicates an excess of oxygen. The oxygen balance value is determined from the time of switching from the rich exhaust gas to the lean exhaust gas until the oxygen excess is detected. The oxygen storage capacity is then determined again from the oxygen balance value.

However, the procedure described is based on the oxygen storage being completely emptied once and completely loaded once to determine the oxygen storage capacity. However, this may negatively affect the fuel consumption of the drive unit and/or the resulting pollutant emissions. For this reason, it should be avoided to completely run through the oxygen storage capacity. Instead, it is provided to set the oxygen level directly to the target level, starting from a completely empty oxygen storage or a completely loaded oxygen storage, namely without an overshoot or at least without excessive overshoot of the oxygen level above the target level.

For this purpose, it is provided that the setting of the oxygen level to the target level occurs when a value of the second measured value occurs, that corresponds to the boundary value of the fill level range the fill level range. The fill level range is to be understood as a range which contains the target fill level. Preferably, the fill level range extends from a first value, which corresponds to a completely empty or discharged oxygen storage to a second value, which corresponds to an oxygen storage that is completely filled or loaded with oxygen.

The boundary value of the fill level range corresponds in particular to either the completely empty or the fully loaded oxygen storage, i.e. an oxygen level of 0% or 100%. The value corresponding to the boundary value is the value of the second measured value that it assumes under the conditions mentioned, i.e. when the oxygen storage is either completely empty or completely loaded. If the currently measured second measured value corresponds to this value, the oxygen storage is either completely empty or completely loaded. Based on this condition, the oxygen level should be brought to the target level by operating the drive unit accordingly, without the target level being (significantly) overshot by the oxygen level, i.e. without overshooting or at least without pronounced overshooting. The value of the second measured value corresponding to the boundary value occurs, for example, during thrust operation of the drive device. A thrust operation means that the drive unit is towed by an external provided torque without fuel being introduced into the drive unit. This means that only air flows through the drive unit, so that the oxygen storage is quickly completely filled with oxygen. Conversely, after operating the drive unit with a rich mixture, the second measured value can be equal to value corresponding to the boundary value, as occurs, for example, when operating the drive unit with high power, for example when operating with a rated power or a maximum power of the drive unit.

In order to adjust the oxygen level to the target level, the composition is first adjusted such that the oxygen level changes by the pilot oxygen amount. The pilot oxygen amount is to be understood as a stored value which serves to set the oxygen level at least approximately to the target value. The pilot oxygen amount is supplied to or discharged from the oxygen storage unit over a certain period of time by operating the drive unit with a specific composition of the fuel-air mixture. Changing the oxygen level by the pilot oxygen amount can be done in different directions. If the oxygen storage is empty, an amount of oxygen corresponding to the pilot oxygen amount is introduced into the oxygen storage. When the oxygen storage is loaded, an amount of oxygen corresponding to the pilot oxygen amount is discharged from the oxygen storage.

After changing the oxygen level by the pilot oxygen amount, the composition of the fuel-air mixture is determined based on the first measured value and the second measured value, more precisely by means of the lambda control. This is done in such a way that the second measured value changes in the direction of a target value corresponding to the target filling level. The control is carried out until the second measured value corresponds to the target value, either exactly or at least within the unavoidable tolerance. During control, the oxygen balance value is determined, i.e. it is recorded how much oxygen is added to the oxygen storage and/or is discharged from it. It is preferably important that the oxygen level is changed exclusively in the direction of the target value during the control period. In particular, it is avoided to change the oxygen level beyond the target value.

If the second measured value has reached the target value, the pilot oxygen amount is corrected by the oxygen balance value. If the oxygen balance value is different from zero, the introduction or removal of the pilot oxygen amount was not sufficient to adjust the oxygen level to the target level and the second measured value does not correspond to the target value.

For example, the pilot oxygen amount is corrected with the oxygen balance value by summing. A new value of the pilot oxygen amount is therefore obtained by adding the previous value of the pilot oxygen amount with the oxygen balance value. The new value is subsequently used as the pilot oxygen amount. The correction adjusts the pilot oxygen amount to the actually required oxygen amount, in particular iteratively. When the oxygen level is subsequently set to the target level, the corrected pilot oxygen amount is used, so that the setting occurs with greater accuracy and the proportion of lambda control in the setting is smaller than before.

In particular, it is provided that with a second measured value that corresponds to the completely filled or loaded oxygen storage the composition is set in such a way that the oxygen level decreases by a pilot oxygen amount into the level range, then the composition is determined during a control period using the lambda control until the second measured value is at least within an unavoidable tolerance equal to the target value corresponding to the target level and finally the pilot oxygen amount is corrected by an oxygen balance value determined during the control period.

Additionally or alternatively, it is provided that with a second measured value, which corresponds to a completely emptied or discharged oxygen storage, the composition is adjusted such that the oxygen level increases by a pilot oxygen amount in the direction of the target value range, then the composition is determined during a control period using the lambda control until the second measured value corresponds to the target value lying in the target value range at least within an unavoidable tolerance and finally the pilot oxygen amount is corrected by the oxygen balance value determined during the control period.

The procedure described enables the oxygen filling level of the oxygen storage unit to be set to the target filling level without the oxygen filling level covering the entire filling level range. This means that while the oxygen level is being adjusted to the target level only a single boundary value of the fill level range is affected by the second measured value, but not both boundary values delimiting the fill level range. This reliably avoids unnecessary pollutant emissions from the drive device and reduces fuel consumption. In addition, the oxygen level is set to the target level in a particularly short period of time.

Overall, the adjustment of the oxygen level to the target level is achieved by means of the trim control, which regulates the second measured value to the target value. This approach is based on the knowledge that the second measured value can give at least an indication of the current oxygen level of the oxygen storage. The oxygen storage capacity of the exhaust gas aftertreatment device is also determined—optionally—from the corrected pilot oxygen amount, in particular depending on the target filling level.

A further development of the invention provides that, as part of the lambda control, the first measured value is regulated to a first target value, wherein the first measured value and/or the first target value are corrected with a trim value, which is determined by means of a trim control based on the second measured value.

The composition of the fuel-air mixture is adjusted using lambda control. The first measured value is measured using the first lambda sensor and regulated to the first target value. The first measured value can also be used as a control variable or as the actual value of the control variable and the first target value can be indicated as a reference variable for the lambda control. The composition of the fuel-air mixture serves as the control variable for lambda control.

In order to improve the accuracy of the lambda control, trim control is also carried out. The second measured value is used in the context of the trim control as a control variable or as the actual value of the control variable. The trim control uses the trim value that results from the trim control as the control variable. The trim value is used to correct the first measured value and/or the first target value. In any case the trim value is incorporated into the lambda control in such a way that a possible error in the first lambda sensor is at least partially or even completely compensated for. For example, the trim control can be used to compensate for an offset error in the first lambda sensor. This makes the accuracy in determining the composition of the fuel-air mixture clearly better.

A further development of the invention provides that as part of the trim control, the second measured value is regulated by setting the trim value to a second target value corresponding to the target value. With the trim control, the second measured value is the control variable or its actual value, the second target value is the reference variable and the trim value is the control variable. The second target value is selected in such a way that any error in the first lambda sensor is compensated for. For example, the second target value corresponds to a combustion air ratio k of one or slightly less than one. The trim control enables the quality of the lambda control to be improved and, accordingly, the composition of the fuel-air mixture to be adjusted more precisely. The second target value, which is used for trim control, corresponds to the target value already mentioned.

A further development of the invention provides that the fill level range, on the one hand, is delimited by a first value corresponding to an oxygen storage device that is completely emptied of oxygen and, on the other hand, by a second value corresponding to an oxygen storage device that is completely filled with oxygen. The level range extends from an oxygen level of 0% to an oxygen level of 100%; it therefore comprises the entire oxygen storage capacity of the oxygen storage. The first value limits the level range towards smaller values and the second value towards larger values. The above-mentioned boundary value corresponds to either the first value or the second value.

Depending on which of the values corresponds to the boundary value, the oxygen storage is either loaded with oxygen or oxygen is discharged from it, to adjust the oxygen level to the target level. To set the oxygen level to the target level, a case distinction is preferably made and the procedure is selected depending on which of the values corresponds to the boundary value. This means that the procedure described can or is used both when the oxygen storage is completely empty and when it is completely filled. This results in a particularly high degree of flexibility for the method described.

A further development of the invention provides that as the target fill level a fill level value is used, which lies between the first value and the second value and is spaced from both values. The target filling level or the value of the target filling level is therefore greater than the first value and smaller than the second value. This means that the target level is greater than 0% and less than 100%. The target filling level is preferably at least 10%, at least 20% and at least 30% and/or at most 70%, at most 60% and at most 50%. In other words, the target fill level is between 10% and 70%, between 20% and 60% or between 30% and 50% (the values mentioned are included in each case). This will cause the high conversion performance to be achieved.

A further development of the invention provides that a fill level value that is closer to the first value than to the second value is used as the target fill level. It has already been explained above that the optimal conversion performance of the exhaust gas aftertreatment device is present at an oxygen level between 30% and 50% (these values included). Accordingly, it is advantageous to select the target filling level in such a way that it describes the completely emptied oxygen storage rather than the completely loaded oxygen storage. This in turn serves to achieve a particularly high conversion performance of the exhaust gas aftertreatment device.

A further development of the invention provides that it is assumed that the second measured value is equal to the target value when a gradient of the trim value is equal to zero. It is therefore not absolutely necessary to compare the second measured value with the target value. Alternatively, the gradient of the trim value can be evaluated. If the trim value is equal to zero or equal to zero at an otherwise constant operating point of the drive unit, at least within an unavoidable tolerance, it can be assumed that there will be no further intervention by the trim control to change the oxygen level in the direction of the target level. Consequently, the control period can be ended and the pilot oxygen amount can be corrected by the oxygen balance value.

It can also be provided that the control period is only ended when both the second measured value is equal to the target value, at least within the unavoidable tolerance, and the gradient of the trim value is equal to zero. Only under this condition will the pilot control oxygen amount be corrected by the oxygen balance value and the method for adjusting the oxygen level to the target level is completed. This results in particularly reliable adjustment of the oxygen level.

A further development of the invention provides that the second measured value during the control period is maintained continuously in a target value range corresponding to the fill level range at a distance from another boundary value opposite the boundary value. The target value range therefore corresponds to a value range that corresponds to the fill level range. On the one hand, the target value range is delimited by a value assumed by the second measured value when the oxygen storage is completely empty, and on the other hand by a value that the second measured value assumes when the oxygen storage is completely filled. The adjustment of the oxygen level to the target level is now carried out in such a way that the second measured value is continuously spaced from the further boundary value, which is opposite the boundary value or delimits the target value range on the opposite side. This avoids running through the entire fill level range.

A further development of the invention provides that the second measured value is adjusted continuously and consistently in the direction of the target value during the control period. The lambda control is carried out in such a way that the second measured value changes continuously in the same direction, namely in the direction of the target value. In particular, it should be prevented that the second measured value changes again in the direction of the value corresponding to the boundary value. Such a procedure enables the oxygen level to be adjusted particularly quickly to the target level.

The invention further relates to a drive device, in particular for carrying out the method according to the statements in the context of this description, with a drive unit that generates exhaust gas and an exhaust gas aftertreatment device for aftertreatment of the exhaust gas, wherein the drive device is intended and designed to determine a composition of a fuel-air mixture used to operate the drive unit at least temporarily by means of a lambda control based on a first measured value of a first lambda sensor arranged upstream of the exhaust gas aftertreatment device and based on a second measured value of a second lambda sensor arranged downstream of the exhaust gas aftertreatment device.

The drive device is further provided and designed to adjust an oxygen filling level of an oxygen storage of the exhaust gas aftertreatment device to a target filling level after an occurrence of a value of the second measured value, which corresponds to a boundary value of a fill level range that accommodates the target fill level, to adjust the composition in such a way that the oxygen fill level changes by a pilot oxygen amount in the direction of the target fill level, then to determine, during a control period the composition using the lambda control, until the second measured value is at least within an unavoidable tolerance equal to a target value corresponding to the target filling level and finally to correct the pilot oxygen amount by an oxygen balance value determined during the control period.

The advantages of such a configuration of the energy storage device and of such a procedure have already been discussed. Both the drive device and the method for its operation can be developed further according to the statements made in the context of the present description, so that reference is made to this.

The features and feature combinations described in the description, in particular the features and feature combinations described in the following description of the figures and/or shown in the figures are usable not only in the particular specified combination but rather also in other combinations or alone, without leaving the scope of the present invention. The invention should therefore also be considered to comprise embodiments that are explicitly not shown or explained in the description and/or the figures, but emerge from the explained embodiments or can be derived from them.

BRIEF DESCRIPTION OF THE FIGURES

In the following, the invention will be explained in greater detail with reference to the exemplary embodiments depicted in the drawings, without this restricting the invention. In the figures.

DETAILED DESCRIPTION

Figure 1:
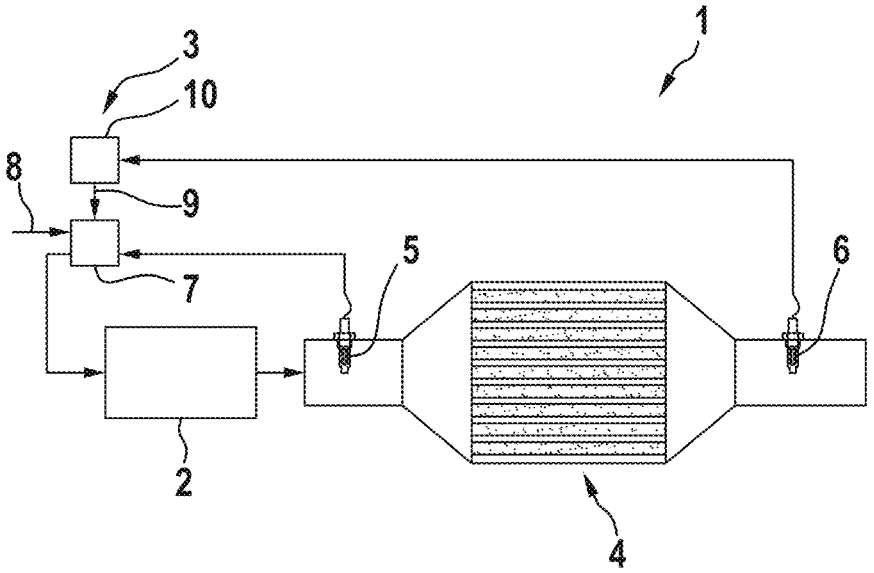
FIG. 1 is a schematic representation of a drive device with a drive unit and an exhaust gas aftertreatment device.

FIG. 1 shows a schematic representation of a drive device 1, which is used, for example, to drive a motor vehicle. In general, the drive device 1 serves to provide a drive torque, namely by means of a drive unit 2. During its operation, the drive unit 2 is supplied with a fuel-air mixture with a specific composition. The composition is determined using a device 3 for carrying out lambda control. During operation of the drive unit 2 exhaust gas is generated, which is removed from the drive unit 2 and fed to an exhaust gas aftertreatment device 4. With respect to a main flow direction of the exhaust gas, the first lambda sensor 5 is located upstream of the exhaust gas aftertreatment device 4 and the second lambda sensor 6 is located downstream of the exhaust gas aftertreatment device 4.

The two lambda sensors 5 and 6 are used to detect a residual oxygen concentration in the exhaust gas. A measured value delivered by the first lambda sensor 5 is used as the first measured value and a measured value delivered by the second lambda sensor 6 is used as the second measured value. The first measured value serves as the input variable of a first sub-device 7 of the device 3. The actual lambda control of the composition of the fuel-air mixture is carried out in this. In the first sub-device 7, the composition is determined based on the first measured value and a setting value is determined according to the arrow 8. In addition, a trim value is transmitted to the first sub-device 7 according to the arrow 9, which trim value is also used to determine the composition. In particular, the first measured value and/or a first target value determined from the setting value is corrected with the trim value.

The trim value is determined using a second sub-device 10 of the device 3, which is used to carry out a trim control. The trim control is carried out using the second measured value of the second lambda sensor 6 by setting the second measured value to a second target value. value is regulated, which is also determined, for example, from the default value.

Figure 2:
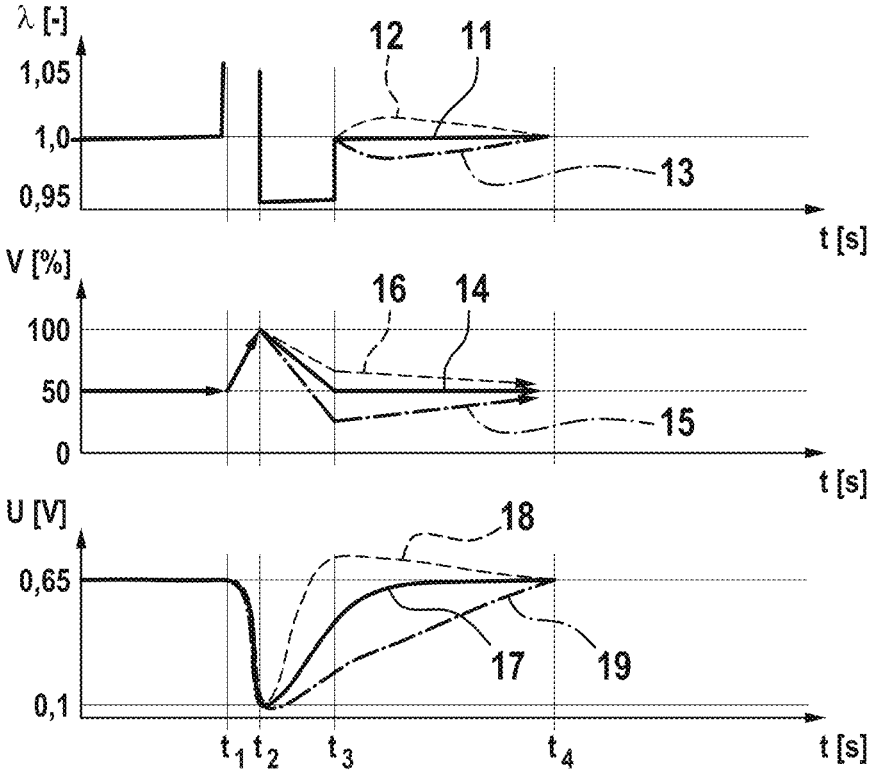
FIG. 2 shows several diagrams in which different state variables of the drive device are plotted over time.

FIG. 2 shows several diagrams in which different courses are plotted over time t. The top first diagram shows the first measured value of the first lambda sensor 5 in courses 11, 12 and 13. These courses 11, 12 and 13 are identical for and between times $t_1$, $t_2$ and $t_3$ and only differ starting from time $t_3$. The central second diagram shows courses 14, 15 and 16 for an oxygen level of an oxygen storage of the exhaust gas aftertreatment device 4. The courses 14, 15 and 16 are identical for and between the periods $t_1$ and $t_2$, but differ starting from time $t_2$. The lower third diagram shows courses 17, 18 and 19 for the second measured value of the second lambda sensor 6. The courses 17, 18 and 19 are identical for and between times $t_1$ and $t_2$, but differ starting from time $t_2$.

The diagram above shows that the first measured value was before time $t_1$ corresponds to a stoichiometric composition of the fuel air mixture that is supplied to the drive unit 2. From time $t_1$, a thrust operation of the drive device 1 or the drive unit 2 is carried out, the drive unit 2 is therefore towed by an externally provided torque and the fuel supply to the drive unit 2 is interrupted. This means that through the drive unit 2 exhaust gases with a high proportion of air or oxygen excess enters the exhaust gas aftertreatment device 4.

This can be seen in the oxygen level of courses 14, 15 and 16, which increases from time $t_1$ up to time $t_2$ to 100%. The oxygen storage at time $t_2$ is therefore completely filled with oxygen. This circumstance can also be recognized from courses 17, 18 and 19: The second measured value decreases between time $t_1$ and time $t_2$ starting from an initial value of, for example, approximately 0.65 V. The value to which the second measured value falls corresponds, for example, to a boundary value of a level range containing a target filling level of the oxygen storage.

After such a value of the second measured value occurs, the oxygen level should be set to a target level, which in the exemplary embodiment shown here is 50%. Tho this end, initially, starting from time $t_2$ to time $t_3$ the oxygen level is changed by a pilot oxygen amount in the direction of the target level by appropriate operation of the drive unit 2. This measure is completed at time $t_3$. In the case of courses 11, 14 and 17, the pilot control oxygen amount is sufficient to adjust the oxygen level up to the target level. This can be seen in courses 14 and 17.

From time $t_3$ the composition of the fuel-air mixture is determined using the lambda control. In this context, the trim control is also carried out, as part of which the second measured value is regulated to a target value which corresponds to the target filling level. Courses 12 and 13 show the influence of the trim control on the first measured value. For course 12, the pilot oxygen amount was too small, so that more oxygen has to be subsequently added to the oxygen storage. Course 12 corresponds to courses 15 and 18.

For course 13, however, the amount of pilot control oxygen was too large. Accordingly, oxygen must be discharged from the oxygen storage as part of the lambda control or trim control. The course 13 corresponds to the courses 16 and 19. It can be seen that at the time $t_4$ the second measured value has reached the target value. Correspondingly, courses 15 and 16 have also reached the target level and according to courses 12 and 13, the intervention of the trim control has also decreased. The latter means in particular that a gradient of the trim value, which results from the trim control and is used to correct the lambda control, is equal to zero or at least almost equal to zero.

The procedure described enables particularly quick adjustment of the oxygen level to the target level, in particular without running through the entire level range. This achieves a reduction in fuel consumption of the drive device 1 and a reduction in pollutant emissions.

LIST OF REFERENCE NUMERALS

1 drive device
2 drive unit
3 device
4 exhaust gas aftertreatment device
5 first lambda sensor
6 second lambda sensor
7 first sub-device
8 arrow
9 arrow
10 second sub-device
11 course
12 course
13 course
14 course
15 course
16 course
17 course
18 course
19 course

The invention claimed is:

1. A drive device comprising:

an engine;

an exhaust gas aftertreatment device comprising an oxygen storage device having a target fill level;

a first lambda sensor arranged upstream of the exhaust gas aftertreatment device and configured to measure a first value of residual oxygen content of the exhaust gas upstream of the exhaust gas aftertreatment device, wherein the first lambda sensor is a broadband lambda sensor;

a second lambda sensor arranged downstream of the exhaust gas aftertreatment device and configured to measure a second value of residual oxygen content of the exhaust gas downstream of the exhaust gas aftertreatment device, wherein the second lambda sensor is a jump lambda sensor; and a control circuit configured to:

carry out lambda control of the engine;

determine a composition of a fuel-air mixture supplied to the engine based upon the first measured value and the second measured value;

adjust an oxygen filling level of the oxygen storage device of the exhaust gas aftertreatment device to the target fill level based upon the first measured value and the second measured value, after an occurrence of a value of the second measured value, which corresponds to a boundary value of a fill level range that accommodates the target fill level:

adjust the composition of the fuel-air mixture supplied to the engine to change an oxygen fill level by a pilot oxygen amount exclusively in a direction of the target fill level and not exceeding the target fill level; and during a regulation period, adjust the composition of the fuel-air mixture supplied to the engine until the second measured value is at least within an unavoidable tolerance equal to a target value corresponding to the target fill level; and correct the pilot oxygen amount by an oxygen balance value determined during a control period.

2. The drive device of claim 1, wherein the drive device is further configured to correct the first measured value to a first target value with a trim value, which is determined by trim control with the second measured value.

3. The drive device of claim 2, wherein the drive device is further configured to regulate the second measured value by setting the trim value to a second target value.

4. The drive device of claim 1, wherein the drive device is further configured to define a filling level range between a first value corresponding to the oxygen storage device being completely empty and a second value corresponding to the oxygen storage device being completely filled with oxygen.

5. The drive device of claim 4, wherein the drive device is further configured to use a fill level value which lies between the first value and the second value and is spaced from both values.

6. The drive device of claim 4, wherein the drive device is further configured to use a fill level value which is closer to the first value than to the second value.

7. The drive device of claim 1, wherein the drive device is further configured to set the second measured value to the target value after a gradient of the trim value is equal to zero.

8. The drive device of claim 1, wherein the drive device is further configured to hold the second measured value during a control period in a target value range corresponding to a fill level range at a distance from a second boundary value opposite to a first boundary value.

9. The drive device of claim 1, wherein the drive device is further configured to adjust the second measured value in a direction of the target value during a control period.

10. The drive device of claim 2, wherein the drive device is further configured to gradually reduce a gradient of the trim value to zero.

11. The drive device of claim 2, wherein the drive device is further configured to define a filling level range between a first value corresponding to the oxygen storage device being completely empty and a second value corresponding to the oxygen storage device being completely filled with oxygen.

12. The drive device of claim 3, wherein the drive device is further configured to define a filling level range between a first value corresponding to the oxygen storage device being completely empty and a second value corresponding to the oxygen storage device being completely filled with oxygen.

13. The drive device of claim 5, wherein the drive device is further configured to set the target fill level for the fill level value between 10% and 70%.

14. The drive device of claim 13, wherein the drive device is further configured to set the target fill level for the fill level value between 20% and 60%.

15. The drive device of claim 14, wherein the drive device is further configured to set the target fill level for the fill level value between 30% and 50%.

16. The drive device of claim 2, wherein the drive device is further configured to set a target oxygen level to 50%.

17. The drive device of claim 3, wherein the drive device is further configured to set a target oxygen level to 50%.

18. The drive device of claim 4, wherein the drive device is further configured to set a target oxygen level to 50%.

19. The drive device of claim 5, wherein the drive device is further configured to set a target oxygen level to 50%.

* * * * *